United States Patent [19]

Hansberry, Jr.

[11] 4,373,761

[45] Feb. 15, 1983

[54] COMBINED ARTICLE MOVER AND WORKER SUPPORT

[76] Inventor: Charles J. Hansberry, Jr., P.O. Box 764, Exton, Pa. 19341

[21] Appl. No.: 180,480

[22] Filed: Aug. 22, 1980

[51] Int. Cl.[3] ..... A47B 83/00; E04G 3/16

[52] U.S. Cl. ..... 312/250; 312/235 R; 312/237; 182/17; 182/132

[58] Field of Search ..... 312/250, 235 R, 259, 312/237; 280/79.1 R, 79.2, 47.34, 47.35; 182/132, 129, 17; 248/129; 108/23

[56] References Cited

U.S. PATENT DOCUMENTS

| | | | |
|---|---|---|---|
| 134,691 | 1/1873 | Martindale | 312/235 R |
| 827,050 | 7/1906 | Weston | 312/346 |
| 1,440,645 | 1/1923 | Sullivan | 182/132 |
| 1,662,730 | 3/1928 | Wertenberger et al. | 280/79.1 R |
| 2,563,436 | 8/1951 | Toth | 312/235 R |
| 2,972,394 | 2/1961 | Grant | 182/132 |
| 3,166,028 | 1/1965 | Bagel | 108/23 |
| 3,392,801 | 7/1968 | Gethmann | 182/129 |
| 3,493,725 | 2/1970 | MacKay | 312/236 |
| 3,552,521 | 1/1971 | Tate | 182/132 |
| 3,870,333 | 3/1975 | Burdick et al. | 280/79.1 R |
| 3,897,080 | 7/1975 | Isom | 312/235 R |
| 4,063,616 | 12/1977 | Gutierrez | 182/17 |
| 4,174,021 | 11/1979 | Barlock | 182/129 |

FOREIGN PATENT DOCUMENTS

| | | | |
|---|---|---|---|
| 1161872 | 9/1958 | France | 312/250 |
| 1266348 | 3/1972 | United Kingdom | 280/79.1 |

*Primary Examiner*—Victor N. Sakran

*Attorney, Agent, or Firm*—Marvin S. Towsend

[57] ABSTRACT

A combined article mover and worker support comprising a plurality of stepped horizontal platforms or steps, at least one of which is supported vertically by vertical frame members, and a handle, supported by one of the steps, which projects vertically above the uppermost step and serves to maintain the balance of a worker standing on the uppermost step. A tool receptacle or support may be placed on the uppermost step providing ready access to tools for the worker and also providing additional means to maintain the balance of a worker standing on the uppermost step.

2 Claims, 1 Drawing Figure

COMBINED ARTICLE MOVER AND WORKER SUPPORT

FIELD OF THE INVENTION

The invention is in the area of wheeled carts with elevated platforms. Specifically, the invention relates to a cart having a plurality of stepped platforms, the cart serving as both a mover for articles, particularly tools employed by a worker, and a support for a worker standing on the uppermost platform.

BACKGROUND OF THE INVENTION

Stepped article movers are known in the prior art. A representative stepped article mover is shown in U.S. Pat. No. 3,870,333 in which there is no teaching that the article mover can also serve as a worker support. Actually, such an article mover would be dangerous if employed as a worker support because no provision is made for assisting a worker in maintaining his balance on an elevated platform. Even the handle which is used for moving the cart around is oriented in a plane parallel to the stepped platforms and is thus not available to assist a worker in maintaining his balance on an elevated platform.

Stepped worker supports are known in the prior art as shown by representative U.S. Pat. No. 3,552,521 in which a stepped platform serves as a support for a worker and also serves as a support for a vacuum cleaner employed by the worker. Two uppermost horizontal frame members of the apparatus serve as an aid in maintaining the workers balance. However, the design of the frame requires that the elevated platforms are supported by horizontal frame members which are connected to and supported by the vertical frame members. Thus, in addition to having four vertical frame members, a three step support requires six horizontal frame members. If a two step support were designed, then four horizontal frame members would be required.

The vacuum cleaner, as shown in U.S. Pat. No. 3,552,521, is of low profile, of much less height than the two uppermost horizontal frame members which serve to maintain the balance of the worker. Thus the vacuum cleaner itself does not function to assist the worker in maintaining his balance.

A variety of mobile tool stands are shown in the prior art (e.g. U.S. Pat. Nos. 1,097,163, 1,660,521, and 2,981,549), none of which provide for retaining the tools on an elevated platform and assisting in the balance of a worker on the elevated platform.

The prior art (e.g. U.S. Pat. Nos. 2,701,168, 2,969,123, and 2,970,668) disclose elevated mechanics platforms wherein the mechanic reclines upon the elevated platform. There is no provision in these patents for the mechanic to stand upright and retain his balance in the standing position. Also, there is no provision for the elevated platform to support tools along side the mechanic.

In view of the deficiencies and inadequacies described above, it is an object of the invention to provide a combined stepped article mover which includes means for assisting a worker in maintaining his balance if he works on an elevated platform.

Another object of the invention is to provide a handle for a stepped article mover which is oriented so as to assist a worker in maintaining his balance on an elevated platform.

Another object of the invention is to provide a stepped support wherein no horizontal frame members are needed to supplement the vertical frame members of the support.

Another object of the invention is to provide an elevated tool holder which also serves to assist a worker in maintaining his balance when standing on an elevated platform.

Another object of the invention is to provide an elevated mechanics platform which is designed to support the mechanic in a standing position and retain tools along side the mechanic.

Additional objects, advantages, and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, the combined article mover and worker support of the invention may comprise: a plurality of stepped horizontal platforms or steps at least one of which is supported vertically by vertical frame members; and a handle, supported by one of the horizontal platforms or steps, which projects vertically above the uppermost platform or step. The handle serves as means for moving the combined article mover and worker support of the invention from place to place and preferably also serves to assist a worker in maintaining his balance.

The platforms or steps are designed to bear the weight of a standing worker in a stable manner so that the overall article mover and worker support will not tip over and so that the worker can readily stand and move around on the steps or platforms without his balance being precarious.

Preferably, an electrical outlet is attached to one of the platforms or steps to provide the worker with ready access to electric power.

In a further aspect of the present invention, in accordance with its objects and purposes, the combined article mover, tool support, and worker support comprises: a plurality of stepped horizontal platforms or steps at least one of which is supported vertically by vertical frame members; a handle, supported by one of the horizontal platforms or steps, which projects vertically above the uppermost platform or step; and a receptacle for tools, supported by one of the platforms or steps, which projects vertically above the uppermost platform or step.

Preferably, the handle serves as both means for moving the combined article mover, tool support, and worker support of the invention from place to place and as means for assisting a worker in maintaining his balance.

Preferably, the tool receptacle serves to assist the worker in maintaining his balance in addition to providing ready access to tools when he stands on one of the stepped platforms or steps.

Preferably, an electrical outlet is attached to the tool receptacle to provide the worker with ready access to electric power.

As a result of employing the invention, the following benefits and advantages are realized. A stepped article mover is provided with means to assist a worker standing on the uppermost step in maintaining his balance. The handle of the stepped article mover is oriented vertically to assist the worker in maintaining his balance. The steps of the article mover are supported by vertical frame members thereby eliminating the need for additional horizontal frame members. The tool receptacle serves to provide a worker with ready access to tools and electric power and, in addition, serves to assist the worker in maintaining his balance while standing on an elevated step.

BRIEF DESCRIPTION OF THE DRAWING

The accompanying drawing, which is incorporated in and forms a part of the specification, illustrates an embodiment of the present invention and, together with the description, serves to explain the principles of the invention. In the drawing:

The FIG. 1 shows a perspective view of one embodiment of the invention.

DETAILED DESCRIPTION OF THE INVENTION

Figure 1:
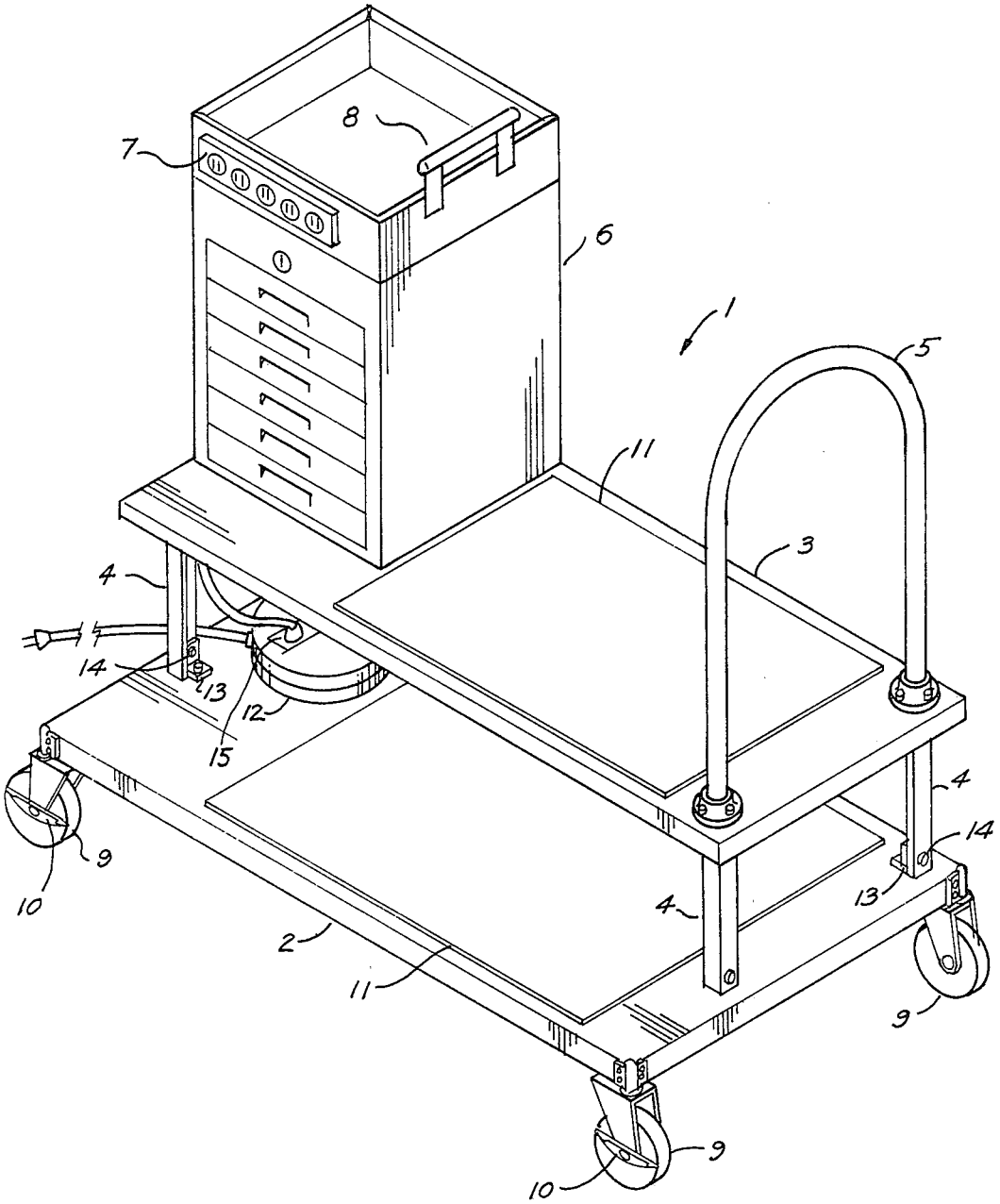

In the FIG. 1 in accordance with the invention, a combined article mover and worker support 1 is comprised of stepped horizontal platforms or steps 2 and 3. Platform or step 2 is lowermost. Platform or step 3 is uppermost. The platforms or steps 2 and 3 are designed to bear the weight of a standing worker in a stable manner so that the overall mover and support 1 will not tip over and so that the worker can readily stand and move around on the steps or platforms 2 and 3 without his balance being precarious. In addition, steps or platforms 2 and 3 are capable of being used for transporting articles from place to place.

In accordance with the invention, step or platform 3 is supported by vertical frame members 4. Handle 5 projects vertically from uppermost platform or step 3 and serves as both means for moving the combined support and mover of the invention from place to place and as means for assisting in maintaining the balance of a worker standing on uppermost step or platform 3.

Tool receptacle 6, supported by platform or step 3, is provided with electrical outlet 7 which receives power from electrical outlet 15 receiving power from the electrical cord retained in cord winder 12. Support bar 8 is attached to tool receptacle 6 and provides means for assisting a worker in maintaining his balance when standing upon platform 3.

For convenience in moving the combined support and mover of the invention from place to place and in locking the device of the invention in a stable position, wheels 9 and locks or brakes 10 are provided, respectively.

For the comfort of the worker and protection of the steps, mats 11 may be used.

It is understood that a combined article mover and worker support of the invention is provided when tool receptacle 6 is absent. A combined article mover, tool support, and worker support is provided when tool receptacle 6 is present as shown in the FIG. 1.

The tool receptacle or support 6 in the absence of support bar 8 still functions to maintain the balance of a worker. However, the presence of support bar 8 facilitates this function.

The presence of electrical outlet 7 is optional, as is the presence of wheels 9, wheel locks 10, and mats 11.

Stepped horizontal steps or platforms 2 and 3 can be connected to vertical frame members 4 by a variety of means including fittings 13 and bolts 14 as shown in the FIG. 1.

Although only two stepped platforms are shown in the FIG. 1, it is understood that any desired number can be employed. In this case, more than one stepped horizontal platform or step would be supported by vertical frame members 4. Both the handle 5 and the tool support or receptacle 6 would, in any case, project vertically above the uppermost platform or step designed to bear the weight of a standing worker.

In view of the foregoing, the following benefits and advantages are realized by employment of the invention. A combined article mover and worker support is provided which allows a worker to readily maintain his balance while standing on an elevated platform or step. Ready access to both tools and electric power is available to the worker. The tool receptacle or support and the handle used to move the device of the invention from place to place both serve to assist the worker in maintaining his balance while standing on an elevated platform or step. The vertical frame members of the invention support the steps without need for additional horizontal frame members.

The foregoing description of a preferred embodiment of the invention has been presented for purposes of illustration and description. It is not intended to be exhaustive or to limit the invention to the precise form disclosed. Obvious modifications and variations are possible in light of the above teaching, for example: a greater number of steps can be used; other articles such as a radio, trash can, etc. can be supported or moved; and the tool receptacle or the handle can be supported on a step lower than the uppermost step, though projecting above it. The embodiment was chosen and described in order to best explain the principles of the invention and its practical application to thereby enable others skilled in the art to best utilize the invention in various modifications as are suited to the particular use contemplated. It is intended that the scope of the invention be defined by the claims appended hereto.

What is claimed is:

1. A combined article mover, tool support, and worker support, comprising:

a. a plurality of stepped horizontal platforms the uppermost of which supports a worker and is supported vertically by vertical frame members;

b. handle means, supported by one of said platforms, said handle means projecting vertically above the uppermost of said plurality of platforms, said handle means for both assisting a worker in maintaining balance and for moving the combined article mover, tool support, and worker support; and c. a receptacle for tools, supported by one of said platforms, said receptacle projecting above the uppermost of said plurality of platforms and including means for assisting in maintaining the balance of a worker; and d. electrical outlet means supported by one of said platforms.

2. A combined article mover, tool support, and worker support as described in claim 1, wherein said electrical outlet means is attached to said receptacle.

* * * * *